US008042334B2

(12) United States Patent
Ribeiro

(10) Patent No.: US 8,042,334 B2
(45) Date of Patent: Oct. 25, 2011

(54) VERTICAL FLUID CONTAINER WITH ENDLESS CHAIN

(76) Inventor: Renato Bastos Ribeiro, Porto Alegre (BR)

( * ) Notice: Subject to any disclaimer, the term of this patent is extended or adjusted under 35 U.S.C. 154(b) by 280 days.

(21) Appl. No.: 12/239,159

(22) Filed: Sep. 26, 2008

(65) Prior Publication Data

US 2009/0090104 A1 Apr. 9, 2009

Related U.S. Application Data

(63) Continuation-in-part of application No. 12/107,913, filed on Apr. 23, 2008, now Pat. No. 7,958,726.

(60) Provisional application No. 60/978,060, filed on Oct. 5, 2007.

(51) Int. Cl.

| | |
|---|---|
| ***F03B 17/02*** | (2006.01) |
| ***F03B 9/00*** | (2006.01) |
| ***F01D 23/00*** | (2006.01) |
| ***F02B 63/04*** | (2006.01) |

(52) U.S. Cl. ..... 60/495; 415/5; 415/916; 290/1 R

(58) Field of Classification Search ..... 60/495, 60/496; 290/1 R; 415/5

See application file for complete search history.

(56) References Cited

U.S. PATENT DOCUMENTS

| | | | | |
|---|---|---|---|---|
| 322,785 | A * | 7/1885 | Bradway | 415/5 |
| 1,708,807 | A * | 4/1929 | Tatay | 40/440 |
| 2,037,973 | A * | 4/1936 | Grondahl | 60/496 |
| 3,865,506 | A | 2/1975 | Gerlach | |
| 4,243,357 | A | 1/1981 | Flynn et al. | |
| 4,326,132 | A | 4/1982 | Bokel | |
| 5,944,480 | A * | 8/1999 | Forrest | 415/5 |
| 7,434,396 | B2 * | 10/2008 | McGahee | 60/495 |
| 2003/0145589 | A1 | 8/2003 | Tillyer | |
| 2007/0201974 | A1 | 8/2007 | Dev | |
| 2007/0283689 | A1 * | 12/2007 | McGahee | 60/504 |

OTHER PUBLICATIONS

"Buoyancy" reference from Wikipedia, the free encyclopedia. Retrieved on-line Apr. 30, 2008: http://en.wikipedia.org/wiki/Buoyancy.

* cited by examiner

*Primary Examiner* — Thomas Denion
*Assistant Examiner* — Christopher Jetton
(74) *Attorney, Agent, or Firm* — Greenberg Traurig, LLP

(57) ABSTRACT

The present disclosure relates to an apparatus and associated methods for generating energy by capturing and taking benefit of the energy generated by any quantity of air surfacing inside water. The apparatus includes a frame structure to which is rotatably mounted an upper drive wheel, a lower wheel, and a vertical fluid column container. An endless chain of gas capsule elements is mounted on the upper and lower wheels. This endless chain passes vertically up into and through the fluid column container through a seal port in the bottom of the container. As the endless chain of gas capsule elements passes vertically through the fluid in the container, fluid pressure on the elements due to the height of the column of fluid in the container produces a net buoyant force upward on the elements, causing them to rise, generating kinetic energy that turns the wheels.

16 Claims, 3 Drawing Sheets

VERTICAL FLUID CONTAINER WITH ENDLESS CHAIN

CROSS REFERENCE TO RELATED APPLICATIONS

This application is a continuation-in-part of U.S. patent application Ser. No. 12/107,913, filed on Apr. 23, 2008, and claims the benefit of priority of U.S. Provisional Patent Application No. 60/978,060, filed on Oct. 5, 2007, both of which are entitled APPARATUS AND ASSOCIATED METHODS TO GENERATE USEABLE ENERGY, the content of which are hereby incorporated by reference herein in their entirety.

BACKGROUND

1. Field

The present disclosure is related to the generation of electrical energy, and more particularly the conversion of kinetic energy in rising air bubbles through water into usable electrical energy.

2. General Background

Energy costs and concerns have highlighted the need for alternative and renewable energy sources. Recent research into different methods of producing energy involving the traditional uses of wind, water, and solar energy has been widespread, This reflects the major threats of climate change due to pollution, exhaustion of fossil fuels, and the environmental, social and political risks of fossil fuels.

One potential source of renewable energy is the kinetic energy created by rising air in water. Air rises in water because it is less dense than water, meaning that a given volume of air weighs less than the same volume of water. Water is nearly 1,000 times denser than air. Any object or substance that weighs less than the amount of fluid it displaces will float on that fluid.

Buoyancy is the upward force on an object produced by the surrounding fluid (i.e., a liquid or a gas) in which it is fully or partially immersed, due to the pressure difference of the fluid between the top and bottom of the object. The net upward buoyancy force is equal to the magnitude of the weight of fluid displaced by the body. This net force enables the object to float or at least to seem lighter.

Buoyancy provides an upward force on the object. The magnitude of this force is equal to the weight of the displaced fluid. The buoyancy of an object depends, therefore, only upon two factors: the object's volume, and the density of the surrounding fluid. The greater the object's volume and surrounding density of the fluid, the more buoyant force it will experience. If the buoyancy of an unrestrained and unpowered object exceeds its weight, it will tend to rise. An object whose weight exceeds its buoyancy will tend to sink. This buoyant force on air bubbles in water causes the air bubbles to rise to the surface.

SUMMARY

In one aspect of the present disclosure, a method and apparatus for generating energy is disclosed. The basic method comprises first introducing a void space such as air into fluid below the surface of the fluid by capturing air in an enclosed tubular capsule element that is introduced beneath the water surface. This capsule is then forced upward by buoyant forces of the fluid on the capsule. Then the capsules in the fluid are allowed to rise to the surface. To generate energy, the kinetic energy in the upwardly moving and subsequently surfacing capsule elements is captured and converted into a useable form of energy.

In a further aspect of the present disclosure, an apparatus generating usable energy from the air or other gas enclosed in a chain of capsule elements and introduced into a column of water or other fluid is disclosed. The apparatus may preferably include a vertical tank filled with a fluid medium. Through this fluid medium a series of capsule elements, linked together in an endless chain, are introduced, one by one, through a sealed entry port at the bottom of the fluid column. The buoyant forces on the capsule elements drive the chain of elements upward through the fluid column. The endless chain of elements exits the top of the column and passes over an upper wheel and then around a lower wheel and back into the entry port at the bottom of the tank.

Finally, a generator is attached to the energy conversion axle to convert the kinetic energy of the moving elements into usable energy. In exemplary embodiments, the energy conversion mechanism comprises a vertical fluid column, a pair of upper and lower gear or pulley wheels outside the fluid column, an endless chain of airtight capsule elements extending between the wheels and capable of rotating the wheels; and a generator communicating with one of the wheels, wherein the capsule elements pass vertically through the fluid column via a fluid tight port at the bottom of the column. The capsule elements displace the fluid, resulting in an upward buoyancy force being exerted on the endless chain of elements, causing upward movement of the elements, thus turning the wheels to rotate a generator rotor to produce useable electrical energy.

DRAWINGS

The foregoing aspects and advantages of the present disclosure will become more readily apparent and understood with reference to the following detailed description, when taken in conjunction with the accompanying drawings, wherein.

DETAILED DESCRIPTION

Figure 1:
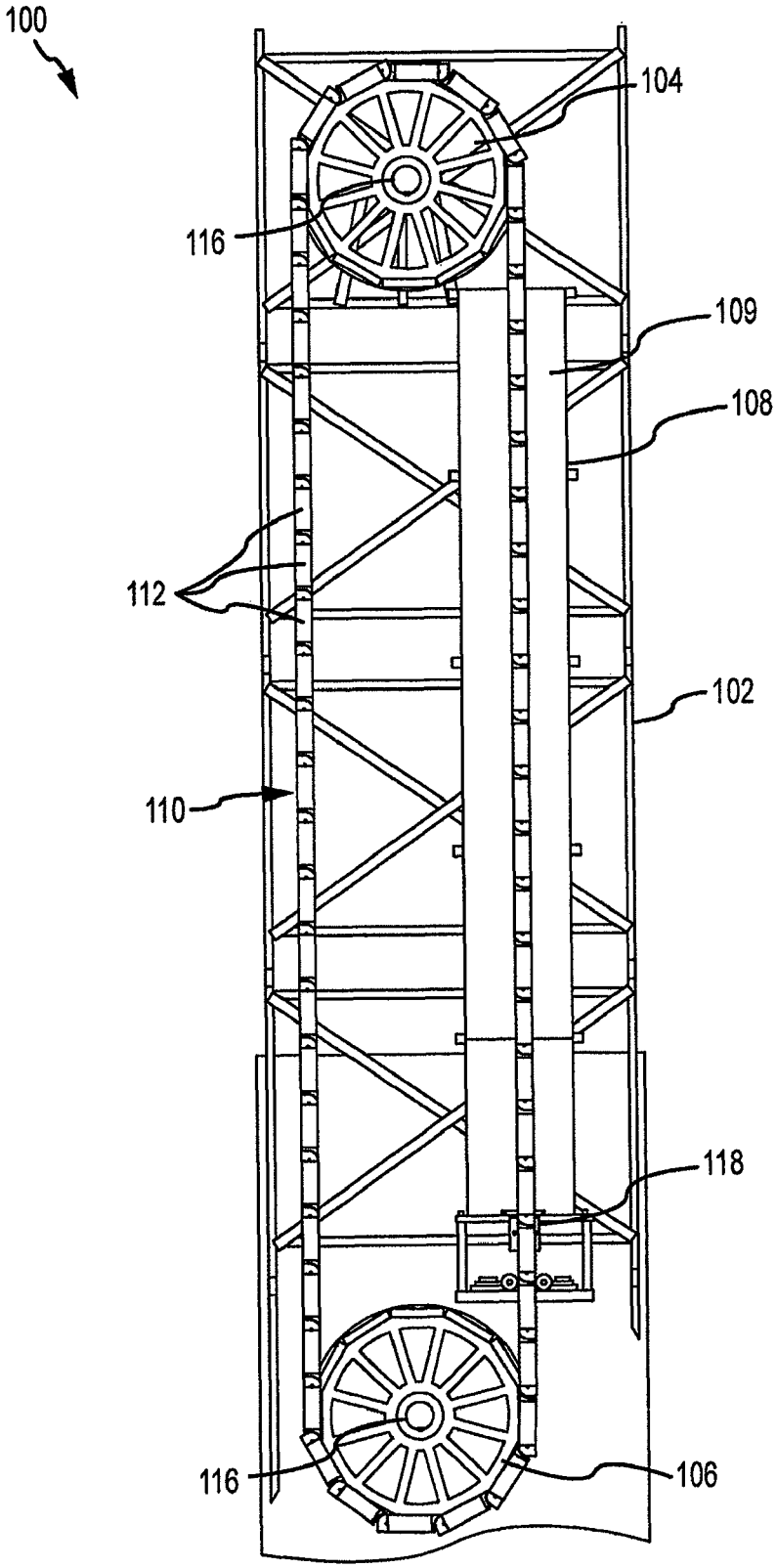
FIG. 1 is a side view of an apparatus in accordance with an embodiment of the present disclosure.

Turning now to the drawings, FIG. 1 is a side view of one embodiment 100 of an apparatus according to the present disclosure. The apparatus 100 includes a frame structure 102 to which is rotatably mounted an upper drive wheel 104, a lower wheel 106, and a vertical fluid column container 108. An endless chain 110 of air capsule elements 112 is mounted on the upper and lower wheels 104 and 106. This endless chain 110 passes vertically up into and through the fluid column container 108 through a seal port 114 in the bottom of the container 108.

As the endless chain 110 of air capsule elements 112 passes vertically through the fluid 109 in the container 108, fluid pressure on the elements 112 due to the height of the column of fluid 109 in the container 108 produces a net buoyant force upward on the elements 112, causing them to rise. The rising elements 112 are connected together such that this motion causes the upper and lower wheels 106 and 108 to turn. An electrical generator (not shown), can be attached to at least one of the axles 116 of the wheels 106 and 108 to convert the kinetic energy of the rotating wheels 106 and 108 to electrical energy. Alternatively, the rotating wheels can directly provide the motive power to other devices in a well known manner to those skilled in the art.

This endless chain 110 of capsule elements 112 is introduced at the bottom, or inferior, part, of the container 108. The chain 110 passes through an entrance seal or glove 118 that has one or more low friction seal ring members 120 that prevent leakage of fluid out of the container 108, while minimizing the restraining or resistive forces being applied to each of the capsule elements 112.

Figure 2:
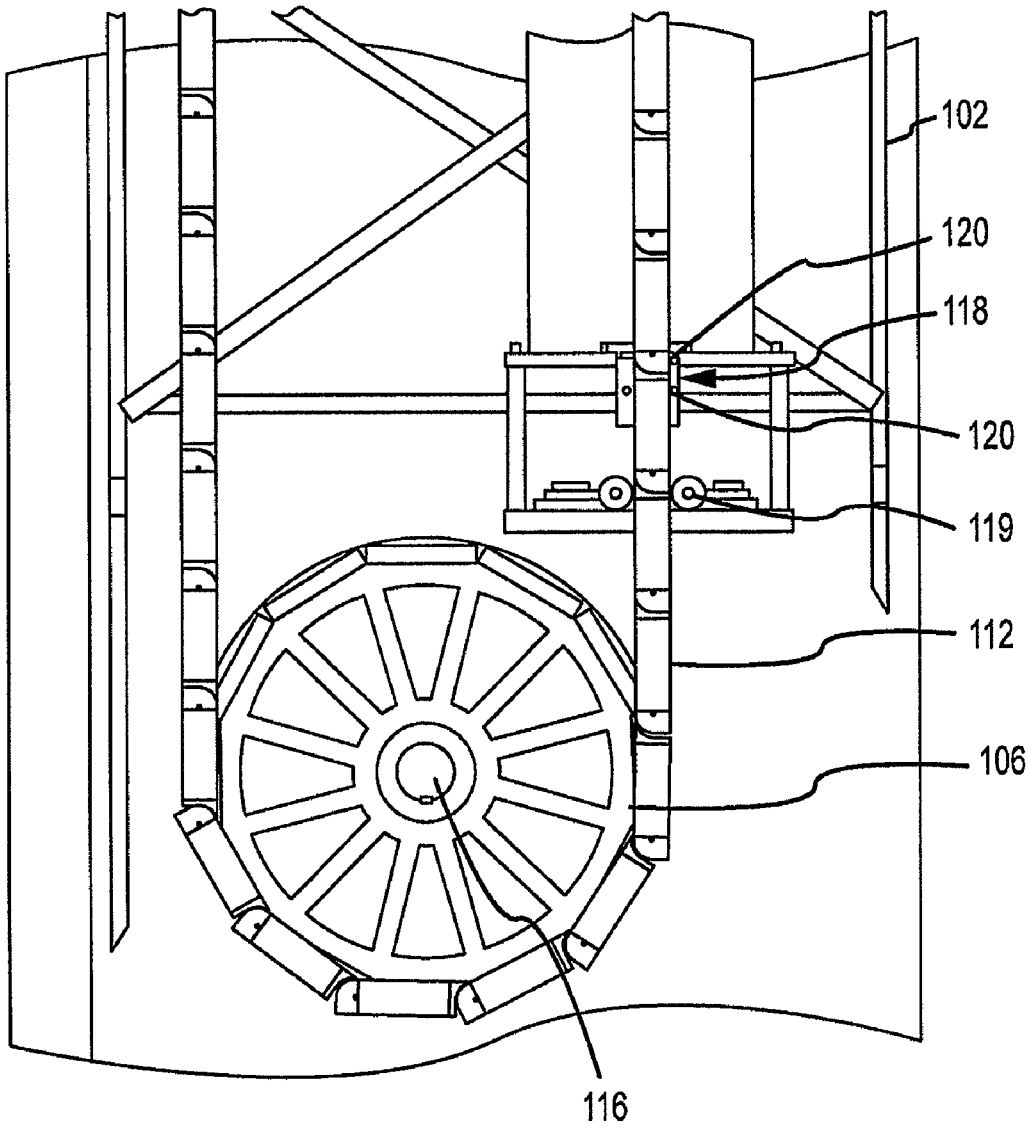
FIG. 2 is a side view of the lower portion of the apparatus in FIG. 1.

Referring now to FIG. 2, the net energy creation generated by the apparatus 100 includes primarily the difference between the energy produced by the buoyancy forces on the air capsule elements in the fluid and the energy consumed by the chain friction as it passes through the entrance glove 118. Preferably this entrance glove 118 has two spaced seals 120 so that as an upper element 112 in the glove 118 passes from the glove into the container 108 the lower seal ring 120 prevents fluid leakage. The glove 118 is preferably preceded by a set of guide rollers 119 mounted beneath the glove 118. A single seal ring 120 may also be utilized in alternative configurations. Such a seal ring 120 may be an O-ring made of a rubber such as a silicon rubber or other suitable material that is compatible with the fluid 109 in the container 108.

Figure 4:
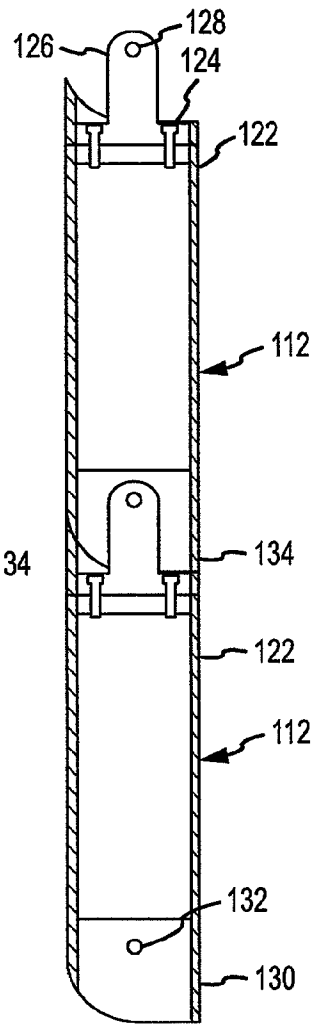
FIG. 4 is a sectional view of the capsule elements shown in FIG. 3.
Figure 3:
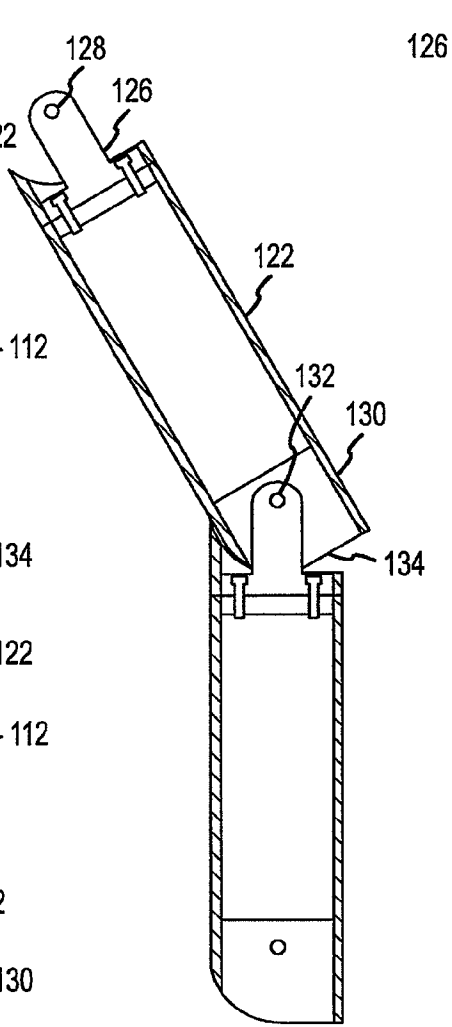
FIG. 3 is a separate side view of two pairs of capsule elements utilized in the endless chain of elements shown in the apparatus of FIG. 1.
Figure 3:
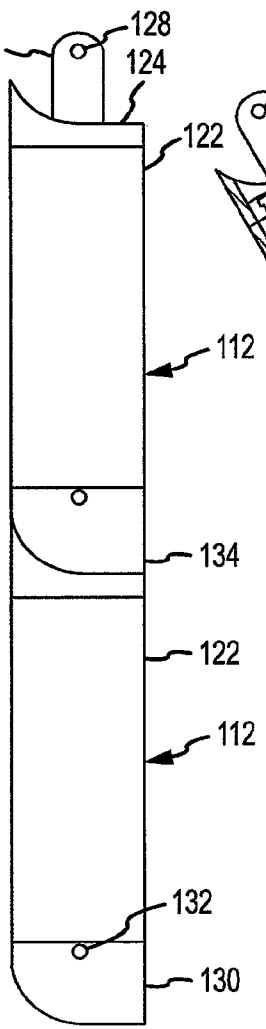
Figure 3:
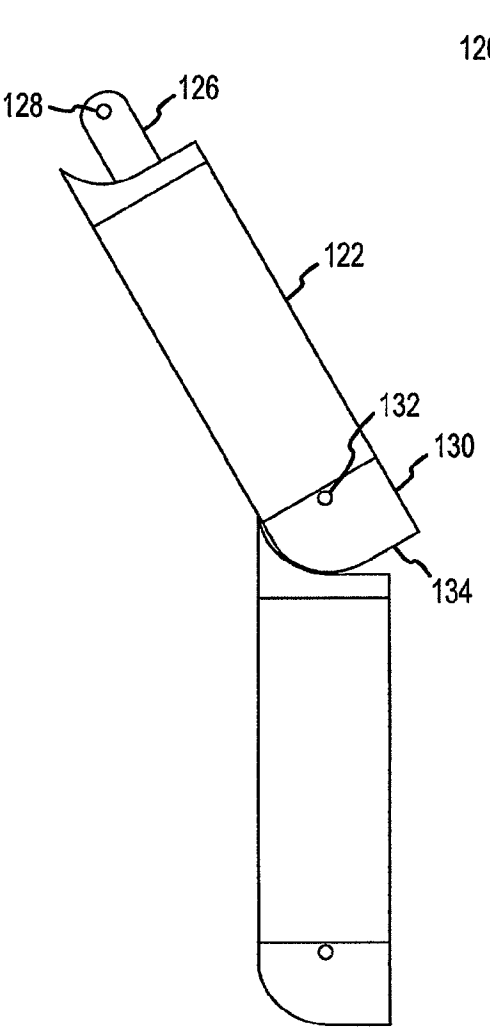

Referring now to FIGS. 3 and 4, each of the capsule elements 112 has a hollow tubular wall 122 having a curved upper end cap 124. Extending axially from the end cap 124 is a linkage tongue 126 that has a hole 128 therethrough. The curve of the upper end cap is a radial curve centered on the hole 128. Closing the opposite end of the tubular wall 122 is a bottom end cap 130. The bottom end cap 130 has a curved end surface complementary to that of the upper end cap 124 and has a central axial blind slot leading to a pivot pin 132. This pivot pin 132 is fixed to the bottom end cap 130 and passes through the hole 128 in the linkage tongue 126 in the next element 112 in the chain 110. There is a small gap 134 between the bottom end cap 130 of each element 112 and the connected top end cap 124 of the next element 112. This permits the fluid forces in the container 108 to be applied to the bottom of each element 112 so that a net positive buoyant force is exerted by the fluid in the container 108 on each element 112 while the element 112 is in the container 108. As is shown in FIG. 4, the gap 134 includes open space within the bottom end cap 130 and the upper end cap 124 that will be filled with the fluid 109.

Each wheel 104 and 106 is mounted on its axle 116 via low friction bearings such that frictional forces on the wheels is minimized. Each wheel 106 and 104 has a peripheral rim shape that is complementary to that of the capsule elements 112. Alternatively the periphery of the wheels 104 and 106 may have teeth or cogs that engage complementary recesses on the elements 112 such that the linear movement of the endless chain 110 of elements 112 up through the container 108 of fluid 109 is efficiently imparted to rotation of the wheels 104 and 106.

Each of the capsule elements 112 is preferably made of a light plastic or metal material such as aluminum and may be coated with a low friction material such as teflon to minimize friction as it passes through the fluid 109 in the container 108.

The container 108 is preferably a right cylinder in shape and may have a rectangular, circular, or other cross sectional shape. The fluid 109 in the container 108 may be water, mineral oil, or other liquid. The fluid 109 could also be a very heavy liquid such as mercury which would impart a tremendous buoyant force on each capsule element 112 that passes into and upward through the fluid 109. The frame 102 may be a metal structural frame that is open, as is shown in the Figures or may be closed to make a completely self contained structure. Further, the axles 116 are bearing supported from the structural frame 102 and each may be linked by conventional means to a motor or generator to make use of the kinetic energy generated by the apparatus 100.

While the above description contains many particulars, these should not be considered limitations on the scope of the disclosure, but rather a demonstration of embodiments thereof. The process and methods disclosed herein include any combination of the different species or embodiments disclosed. Accordingly, it is not intended that the scope of the disclosure in any way be limited by the above description. The various elements of the claims and claims themselves may be combined in any combination, in accordance with the teachings of the present disclosure, which includes the claims.

The invention claimed is:

1. An apparatus comprising:

a structural frame;

a generally vertical fluid container containing a fluid supported on the frame;

an endless chain of gas containing capsule elements having a portion of the elements passing through the fluid in the fluid container;

a wheel rotatably fastened to the frame outside the container, the endless chain of elements passing over the wheel;

the capsule elements being in complementary relationship with each other about the perimeter of each capsule so as to provide a straight line outer surface of the chain of capsule elements around the perimeter of the chain, and wherein each capsule element comprises:

a hollow tubular wall;

a curved concave top cap closing an upper end of the tubular wall;

a bottom convex cap closing a bottom end of the tubular wall; such that the concave top fits in the convex bottom in complementary relationship and a linkage pin supported in the bottom cap engaging a portion of an adjacent element.

2. The apparatus of claim 1 wherein the wheel is rotatably mounted above the container.

3. The apparatus of claim 2 further comprising a second wheel rotatably mounted below the container over which the endless chain of elements pass.

4. The apparatus of claim 2 wherein the fluid container has a bottom configured with a port receiving and passing the capsule elements therethrough into the container.

5. The apparatus of claim 4 wherein the port includes a sealing glove to prevent fluid leakage from the container while permitting passage of the capsule elements onto the container.

6. The apparatus of claim 4 wherein the sealing glove has at least one O-ring seal around the port and around each capsule element as it passes through the port.

7. An apparatus comprising:

a frame;

an elongated fluid container containing a fluid vertically mounted on the frame, the fluid container having a bottom and a port through the bottom;

an upper wheel rotatably mounted to the frame above the container;

a lower wheel rotatably mounted to the frame below the container; and an endless chain of spaced gas containing capsule passing into the container through the port, through the fluid in the container, and out of a top of the container, around a portion of the upper wheel and around a portion of the lower wheel and returning to the port through the bottom of the container, and the capsule elements being in complementary relationship with each other about the perimeter of each capsule so as to provide a straight line outer surface of the chain of capsule elements around the perimeter of the chain as the elements traverse essentially the length of the container, and wherein each capsule element comprises:

a hollow tubular wall;

a curved concave top cap closing an upper end of the tubular wall;

a bottom convex cap closing a bottom end of the tubular wall; such that the concave top fits in the convex bottom in abutting relationship and a linkage pin supported in the bottom cap engaging a portion of an adjacent element.

8. The apparatus of claim 7 wherein the top cap has a tongue member axially protruding therefrom.

9. The apparatus of claim 8 wherein each linkage pin engages with the tongue member of an adjacent capsule element.

10. The apparatus of claim 7 wherein the bottom cap has a curved convex shape complementary to the curved concave top cap of an adjacent capsule element, the top and bottom surfaces respectively being adjacent each other in mating relationship.

11. The apparatus of claim 10 wherein the bottom cap further has a central slot through which the linkage pin passes engaging the portion of an adjacent element.

12. The apparatus of claim 11 wherein the portion of the adjacent element is a tongue member axially protruding from the curved top cap of the adjacent capsule element.

13. The apparatus of claim 7 wherein the port through the bottom of the container includes a sealing glove receiving the capsule elements therethrough.

14. The apparatus of claim 13 wherein the sealing glove includes one or more seals to prevent fluid from passing out of the container while the capsule element enters the container.

15. An apparatus comprising:

a frame;

an elongated fluid container containing a fluid vertically mounted on the frame, the fluid container having a bottom and a port through the bottom;

an upper wheel rotatably mounted to the frame above the container;

a lower wheel rotatably mounted to the frame below the container; and an endless chain of spaced gas containing capsule passing into the container through the port, through the fluid in the container, and out of a top of the container, around a portion of the upper wheel and around a portion of the lower wheel and returning to the port through the bottom of the container, the capsule elements being in complementary relationship with each other about the perimeter of each capsule so as to provide a straight line outer surface of the chain of capsule elements around the perimeter of the chain;

wherein the bottom cap has a curved convex shape complementary to the curved concave top cap of an adjacent capsule element, the top and bottom surfaces respectively being adjacent each other in mating relationship whereby, and wherein each cell has a central axis between the top and bottom of each cell and including a flat surface extending from the concave top and a flat surface extending from the convex bottom.

16. An apparatus comprising:

a frame;

an elongated fluid container containing a fluid vertically mounted on the frame, the fluid container having a bottom and a port through the bottom;

an upper wheel rotatably mounted to the frame above the container;

a lower wheel rotatably mounted to the frame below the container; and an endless chain of spaced gas containing capsule passing into the container through the port, through the fluid in the container, and out of a top of the container, around a portion of the upper wheel and around a portion of the lower wheel and returning to the port through the bottom of the container;

the capsule elements being in complementary relationship with each other about the perimeter of each capsule so as to provide a straight line outer surface of the chain of capsule elements around the perimeter of the chain as the elements traverse essentially the length of the container, wherein each capsule element comprises:

a hollow tubular wall;

a curved concave top cap closing an upper end of the tubular wall;

a bottom convex cap closing a bottom end of the tubular wall; such that the concave top fits in the convex bottom in complementary relationship; and a linkage pin supported in the bottom cap engaging a portion of an adjacent element, and wherein each cell has a central axis between the top and bottom of each cell and including a flat surface extending from the concave top.

* * * * *